US006920225B2

(12) United States Patent
Yonehara et al.

(10) Patent No.: US 6,920,225 B2
(45) Date of Patent: Jul. 19, 2005

(54) ELECTRET CAPACITOR MICROPHONE

(75) Inventors: Kentaro Yonehara, Shizuoka (JP); Motoaki Ito, Shizuoka (JP); Hiroshi Fujinami, Shizuoka (JP); Yoshio Imahori, Shizuoka (JP)

(73) Assignee: Star Micronics., Ltd., Shizuoka (JP)

( * ) Notice: Subject to any disclaimer, the term of this patent is extended or adjusted under 35 U.S.C. 154(b) by 0 days.

(21) Appl. No.: 10/882,290

(22) Filed: Jul. 2, 2004

(65) Prior Publication Data

US 2005/0002538 A1 Jan. 6, 2005

(30) Foreign Application Priority Data

Jul. 4, 2003 (JP) ..... P.2003-192256

(51) Int. Cl.[7] ..... H04R 25/00
(52) U.S. Cl. ..... 381/174; 381/369; 381/191
(58) Field of Search ..... 381/355–357, 381/369, 113, 116, 173, 174, 190, 191, 409, 410; 367/140, 170, 181; 29/25.41

(56) References Cited

U.S. PATENT DOCUMENTS 4,281,222 A * 7/1981 Nakagawa et al. ..... 381/357
4,321,432 A * 3/1982 Matsutani et al. ..... 381/174
6,512,833 B2 * 1/2003 Himori et al. ..... 381/174
2003/0161491 A1 * 8/2003 Yonehara et al. ..... 381/174

FOREIGN PATENT DOCUMENTS

JP 11-187494 A 7/1999

* cited by examiner

*Primary Examiner*—Huyen D. Le
(74) *Attorney, Agent, or Firm*—Sughrue Mion, PLLC

(57) ABSTRACT

To provide an electret capacitor microphone in which change of sensitivity characteristic caused by thermal deformation of an electret layer can be prevented even in the case where a reflow process is carried out. An electret capacitor microphone includes: an electret capacitor portion including a diaphragm, and a back electrode plate disposed opposite to the diaphragm through a spacer; an electrically insulating bush for electrically insulating/supporting an outer circumferential edge portion of the back electrode plate; a metal cover in which the electret capacitor portion and the electrically insulating bush are stored; and a gate spring having a pressing function for elastically pressing the back electrode plate toward the diaphragm to form a predetermined gap between the electrically insulating bush and an inner surface of a rear wall of the metal cover. Consequently, collapse of a spacer-abutting portion of an electret layer is prevented from being caused by thermal expansion.

6 Claims, 5 Drawing Sheets

ELECTRET CAPACITOR MICROPHONE

BACKGROUND OF THE INVENTION

1. Field of the Invention

The present invention relates to an electret capacitor microphone and particularly to an electret capacitor microphone having an electret capacitor portion, an electrically insulating bush, and a metal cover in which the electret capacitor portion and the electrically insulating bush are stored.

2. Description of the Related Art

Generally, an electret capacitor microphone has an electret capacitor portion including a diaphragm, and a back electrode plate disposed opposite to the diaphragm through a spacer; and an impedance conversion device for converting change of capacitance of the electret capacitor portion into change of electrical impedance.

In most cases, this type electret capacitor microphone is configured so that the electret capacitor portion and an electrically insulating bush for electrically insulating/supporting an outer circumferential edge portion of the back electrode plate are stored in a metal cover, for example, as described in JP-A-11-187494. That is, this type electret capacitor microphone is configured so that the back electrode plate and the metal cover are electrically insulated from each other by the electrically insulating bush.

SUMMARY OF THE INVENTION

The electret capacitor microphone described in JP-A-11-187494, however, has the following problem because a rear end portion of the metal cover is caulk-fixed to the electrically insulating bush so that the gap between the diaphragm and the back electrode plate can be kept at a predetermined set value.

That is, when a reflow process needs to be applied to the electret capacitor microphone in order to mount the electret capacitor microphone on a surface of an external board, respective constituent members of the electret capacitor microphone are expanded by heat generated in the reflow process. On this occasion, if the thermal expansion coefficient of the electret capacitor portion or the electrically insulating bush is larger than that of the metal cover, a spacer-abutting portion of an electret layer will collapse because the constituent members inside of the metal cover are expanded by heat so that the constituent members interfere with each other in a state where pressure is produced between the constituent members. As a result, there arises a problem that sensitivity characteristic of the electret capacitor microphone changes because the gap between the diaphragm and the back electrode plate becomes narrower than the set value.

Under such circumstances, an object of the invention is to provide an electret capacitor microphone having an electret capacitor portion, an electrically insulating bush, and a metal cover in which the electret capacitor portion and the electrically insulating bush are stored, wherein change of sensitivity characteristic caused by thermal deformation of an electret layer can be prevented even in the case where a reflow process is applied to the electret capacitor microphone.

The invention is intended to achieve the foregoing object not by adopting a background-art configuration depending on caulk-fixing but by adopting a configuration using an elastic member for keeping the gap between the diaphragm and the back electrode plate at a predetermined set value.

That is, the invention provides an electret capacitor microphone having: an electret capacitor portion including a diaphragm, and a back electrode plate disposed opposite to the diaphragm through a spacer; an electrically insulating bush for electrically insulating/supporting an outer circumferential edge portion of the back electrode plate; a metal cover in which the electret capacitor portion and the electrically insulating bush are stored; an impedance conversion device for converting change of capacitance of the electret capacitor portion into change of electrical impedance; and an elastic member having a pressing function for elastically pressing the back electrode plate toward the diaphragm to thereby form a predetermined gap between the electrically insulating bush and an inner surface of a rear wall of the metal cover.

The electret capacitor microphone according to the invention may be a foil electret type electret capacitor microphone having an electret layer formed in the diaphragm or maybe a back electret type electret capacitor microphone having an electret layer formed in the back electrode plate.

In the electret capacitor microphone according to the invention, specific configurations such as material, shape, etc. are not particularly limited except for the "electret capacitor portion", the "electrically insulating bush", the "metal cover" and the "impedance conversion device."

The specific supporting structure of the "electrically insulating bush" is not particularly limited as long as the "electrically insulating bush" is formed so as to electrically insulate/support the outer circumferential edge portion of the back electrode plate. The term "electrically insulate/support" means to support the outer circumferential edge portion of the back electrode plate in a state in which the back electrode plate and the metal cover are electrically insulated from each other.

The "impedance conversion device" is not limited to a specific device as long as it can convert change of capacitance of the capacitor portion into change of electrical impedance. For example, a field-effect transistor can be used as the "impedance conversion device". The "impedance conversion device" may be stored in the metal cover or may not be stored in the metal cover.

The specific value of the "predetermined gap" is not particularly limited as long as the "predetermined gap" is large sufficient to prevent the spacer-abutting portion of the electret layer from collapse being caused by heat generated in the reflow process.

The specific configuration such as material, shape, etc. of the "elastic member" is not particularly limited as long as the "elastic member" is formed so as to elastically press the back electrode plate toward the diaphragm. The "elastic member" is disposed so as to abut on another member than the back electrode plate in order to press the back electrode plate elastically. The member on which the "elastic member" abuts is not particularly limited. For example, the member may be a rear wall of the metal cover or may be another member than the rear wall of the metal cover.

As shown in the configuration, the electret capacitor microphone according to the invention includes an elastic member having a pressing function for elastically pressing the back electrode plate toward the diaphragm to thereby form a predetermined gap between the electrically insulating bush and the inner surface of the rear wall of the metal cover. Accordingly, collapse of the spacer-abutting portion of the electret layer can be prevented even in the case where a reflow process is applied to the electret capacitor microphone in order to mount the electret capacitor microphone on a surface of an external board.

That is, respective constituent members of the electret capacitor microphone are expanded by heat generated in the reflow process. A predetermined gap is however formed between the electrically insulating bush and the inner surface of the rear wall of the metal cover. Accordingly, even though the thermal expansion coefficient of the electret capacitor portion or the electrically insulating bush is larger than that of the metal cover, pressure interference caused by thermal expansion can be prevented from acting on constituent members of the electret capacitor portion and the electrically insulating bush.

Accordingly, the distance between the diaphragm and the back electrode plate can be prevented from becoming smaller than the set value because of collapse of the spacer-abutting portion of the electret layer. Consequently, sensitivity characteristic of the electret capacitor microphone can be prevented from changing.

Moreover, because the elastic member always elastically presses the back electrode plate toward the diaphragm, the distance between the back electrode plate and the diaphragm can be kept constant by appropriate pressure at all the time before and after the reflow process.

As described above, in accordance with the invention, even in the case where the reflow process is applied to the electret capacitor microphone which is formed so that the electret capacitor portion and the electrically insulating bush are stored in the metal cover, change of sensitivity characteristic can be prevented from being caused by thermal deformation of the electret layer.

When the electrically insulating bush in the configuration is made of a material having a thermal expansion coefficient not larger than that of the metal cover, the gap to be formed between the electrically insulating bush and the inner surface of the rear wall of the metal cover can be minimized by the pressing function of the elastic member. For this reason, reduction in thickness and size of the electret capacitor microphone and improvement in degree of freedom for designing the electret capacitor microphone can be attained.

The configuration may be modified as follows. That is, the metal cover is stored in the housing made of a synthetic resin. The rear wall of the housing is formed by insert molding so as to be integrated with a plurality of terminal members. One end portion of each of the terminal members is exposed as part of the electrically conducting pattern on the inner surface of the rear wall of the housing. The other end portion of each of the terminal members is exposed as one of external connection terminal on the outer surface of the rear wall of the housing. Further, the impedance conversion device is mounted on the inner surface of the rear wall of the housing so as to be located in a predetermined position of the electrically conducting pattern. In this case, the electret capacitor microphone can be mounted on a surface of an external board directly without interposition of any holder or the like. On this occasion, when the elastic member is disposed so as to abut on a predetermined position of the electrically conducting pattern, the elastic member can be used as an electrically conducting member. Accordingly, the electret capacitor microphone can be constituted by a small number of parts and reduction in thickness and size of the electret capacitor microphone can be attained, so that the electret capacitor microphone can be suited to be mounted on a surface of an external board.

The specific shape of the "electrically conducting pattern" is not particularly limited as long as the "electrically conducting pattern" can be formed on the inner surface of the rear wall of the housing. The specific shape, arrangement, etc. of each of the "external connection terminal portions" are not particularly limited as long as the "external connection terminal portions" can be exposed on the outer surface of the rear wall of the housing.

In this case, a plurality of elastic pieces protruding backward may be formed in the rear wall of the metal cover so as to be integrated with the rear wall, and the elastic pieces may be disposed so as to abut on predetermined positions of the electrically conducting pattern. In this configuration, the metal cover and the electrically conducting pattern can be surely electrically connected to each other even in the case where sufficient dimensional accuracy in the front-rear direction of the housing cannot be obtained (for example, in the case where the housing is formed by ultrasonic welding of a pair of housing constituent members).

BRIEF DESCRIPTION OF THE DRAWING

These and other objects and advantages of this invention will become more fully apparent from the following detailed description taken with the accompanying drawings in which.

DETAILED DESCRIPTION OF THE PREFERRED EMBODIMENTS

An embodiment of the invention will be described below with reference to the drawings.

Figure 1:
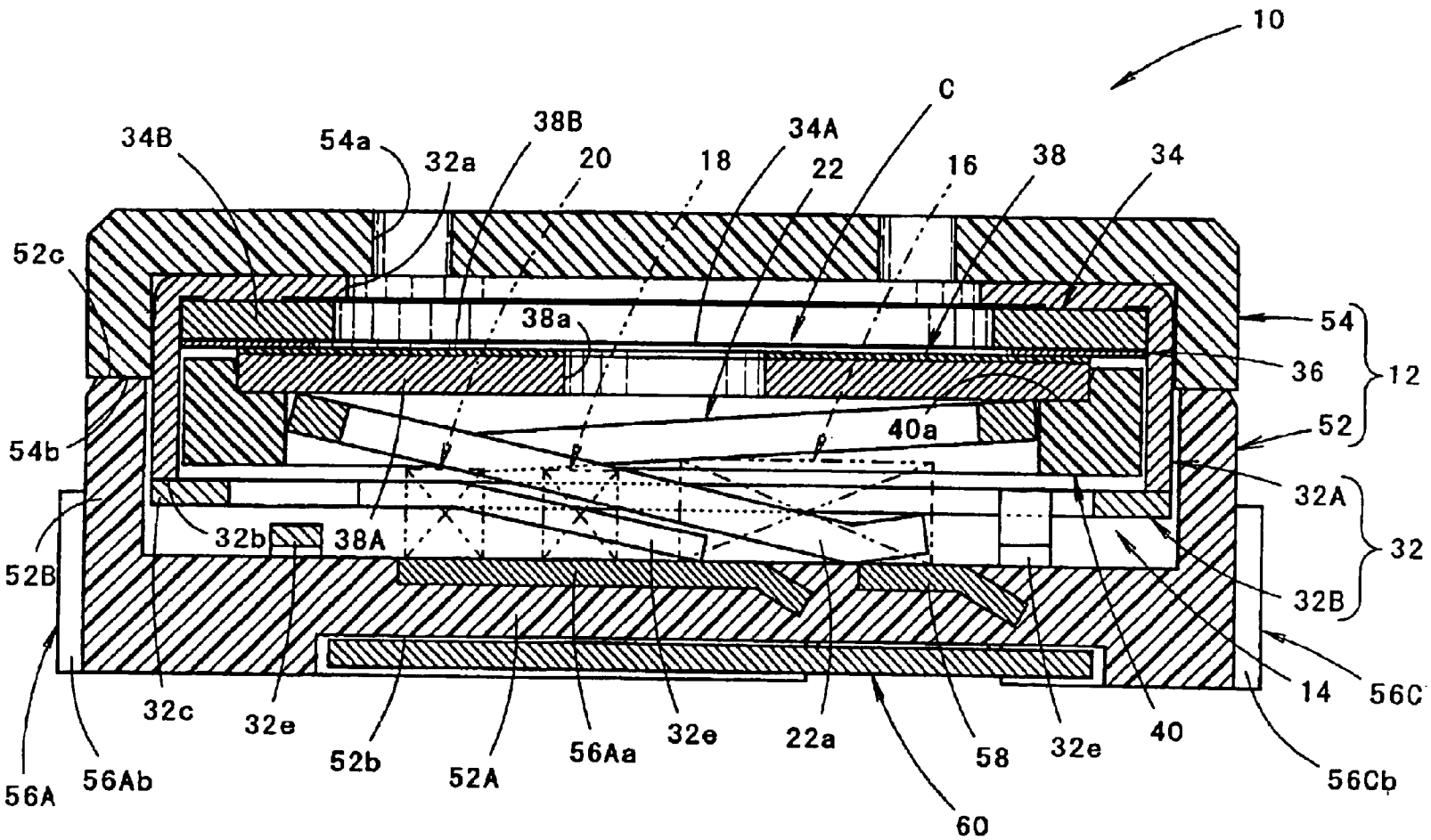
FIG. 1 is a side sectional view of an electret capacitor microphone according to an embodiment of the invention in the case where the electret capacitor microphone is disposed upward.
Figure 2:
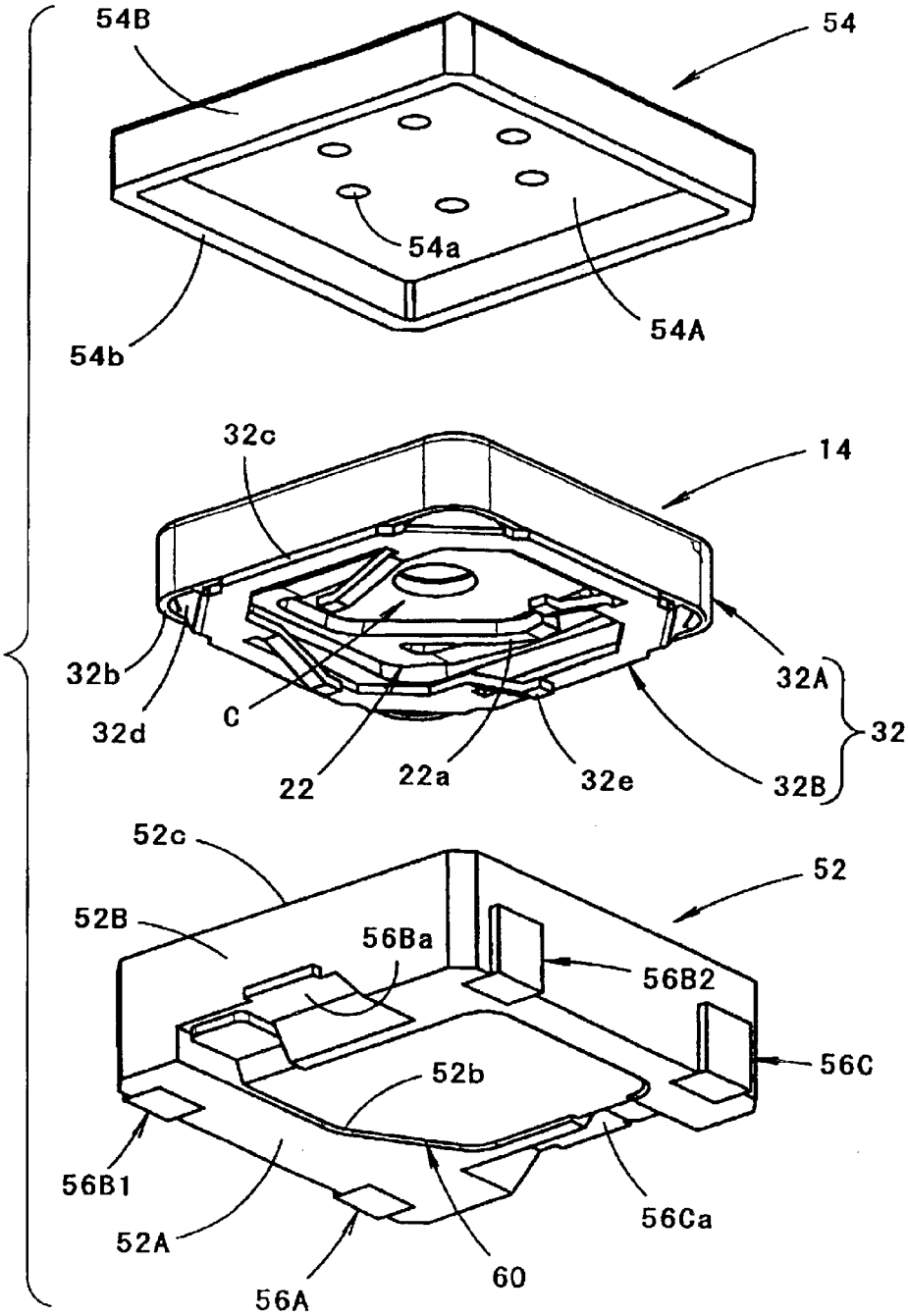
FIG. 2 is an exploded perspective view of the electret capacitor microphone in the case where chief constituent members obtained by exploding the electret capacitor microphone are viewed obliquely from behind.

FIG. 1 is a side sectional view of an electret capacitor microphone according to an embodiment of the invention in the case where the electret capacitor microphone is disposed upward. FIG. 2 is an exploded perspective view of the electret capacitor microphone in the case where the electret capacitor microphone is exploded into chief constituent members and viewed obliquely from behind.

As shown in FIGS. 1 and 2, the electret capacitor microphone 10 according to the embodiment is a small-size microphone substantially having an external shape of a square, about 4.5 mm each side in frontal view and having a height of about 1.8 mm. The electret capacitor microphone 10 has a housing 12 substantially shaped like a rectangular parallelepiped. A microphone assembly 14, a junction type field-effect transistor 16 (impedance conversion device), two capacitors 18 and 20 and a gate spring 22 (elastic member) are stored in the housing 12.

The housing 12 is formed in such a manner that a base housing 52 made of a liquid crystal polymer and opened forward and a top housing 54 made of a liquid crystal polymer and opened backward are fixed to each other by ultrasonic welding.

The microphone assembly 14 is formed in such a manner that a diaphragm sub-assembly 34, a spacer 36, a back electrode plate 38 and an electrically insulating bush 40 are stored in a metal cover 32 which is substantially shaped like a rectangular pipe extending forward and backward and low in height.

Figure 3:
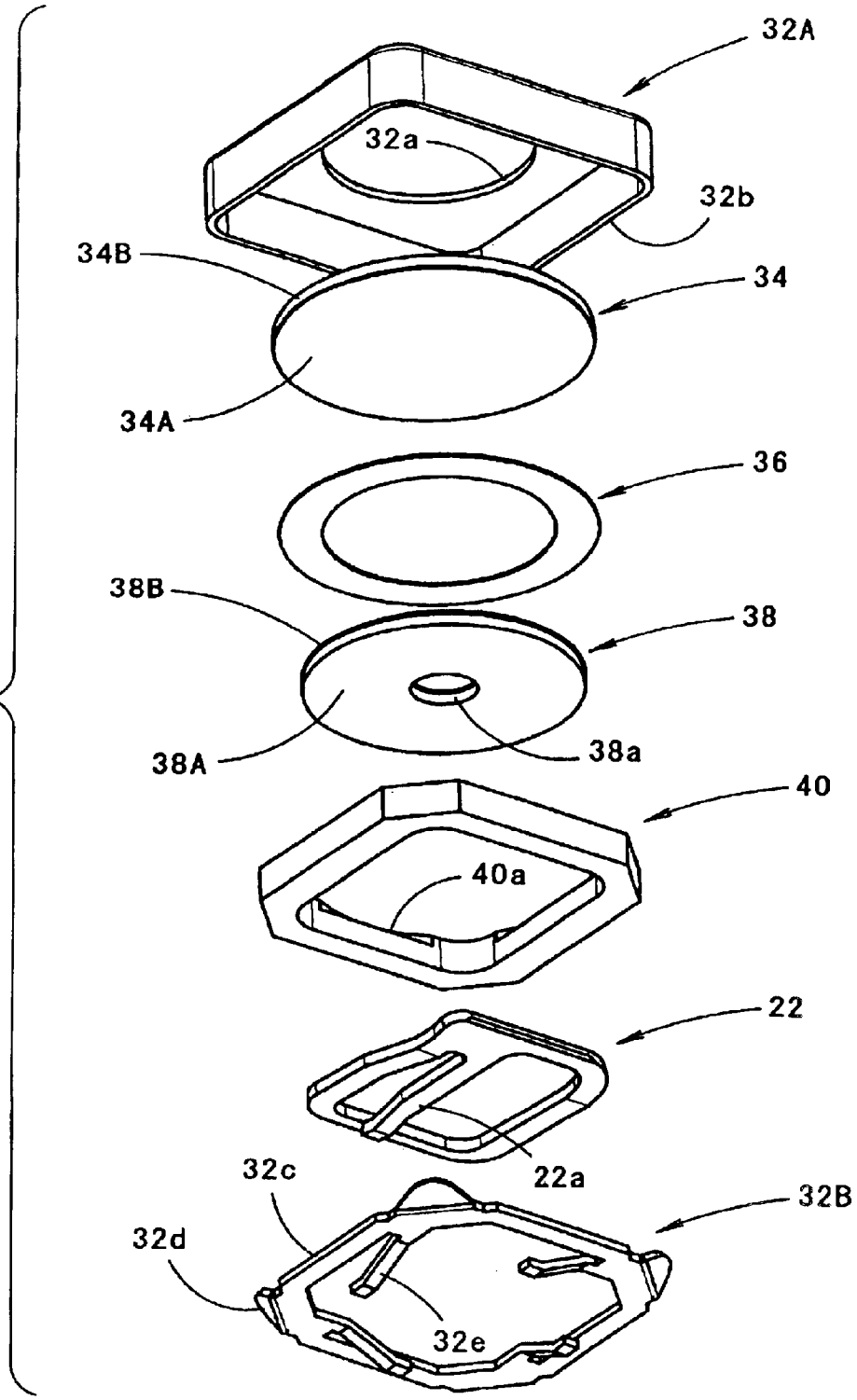
FIG. 3 is an exploded perspective view of a microphone assembly of the electret capacitor microphone in the case where constituent parts obtained by exploding the microphone assembly, together with a gate spring, are viewed obliquely from behind.

FIG. 3 is an exploded perspective view of the microphone assembly 14 in the case where constituent parts obtained by exploding the microphone assembly 14, together with the gate spring 22, are viewed obliquely from behind.

As also shown in FIG. 3, the metal cover 32 has a cover body 32A, and a contact frame 32B. The cover body 32A is made of stainless steel and provided with an acoustic hole 32*a* formed in its front wall. The contact frame 32B is made of stainless steel and welded to an open rear end edge 32*b* of the cover body 32A.

The diaphragm sub-assembly 34 has a diaphragm 34A, and a diaphragm support ring 34B. The diaphragm 34A is fixedly set up on a rear surface of the diaphragm support ring 34B so as to be stretched. The diaphragm 34A has a circular high-molecular film (such as a PPS (polyphenylene sulfide) film) about 1.5 $\mu$m thick, and a metal film (such as a gold or nickel alloy film) deposited on a front surface of the high-molecular film. The diaphragm support ring 34B is made of a stainless steel ring member having an outer diameter substantially large enough to touch internally the metal cover 32.

The spacer 36 is made of a stainless steel thin-plate ring about 25 $\mu$m thick. The outer diameter of the spacer 36 is set to be nearly equal to the outer diameter of the diaphragm support ring 34B.

The back electrode plate 38 has an electrode plate body 38A, and an electret layer 38B thermally welded onto a front surface of the electrode plate body 38A. The outer diameter of the back electrode plate 38 is set to be slightly smaller than the outer diameter of the diaphragm support ring 34B. A back pressure regulating hole 38*a* shaped like a column having a diameter of about 0.8 mm is formed in the central portion of the back electrode plate 38.

The electrode plate body 38A is made of a stainless steel plate about 0.15 mm thick. On the other hand, the electret layer 38B is made of an FEP (fluorinated ethylene propylene) film about 25 $\mu$m thick. The electret layer 38B is subjected to a poling process due to corona discharge or the like, so that a predetermined surface potential is given to the electret layer 38B.

In the metal cover 32, the diaphragm 34A and the electret layer 38B face each other with a predetermined microspace through the spacer 36 to thereby form a capacitor portion C.

Figure 4:
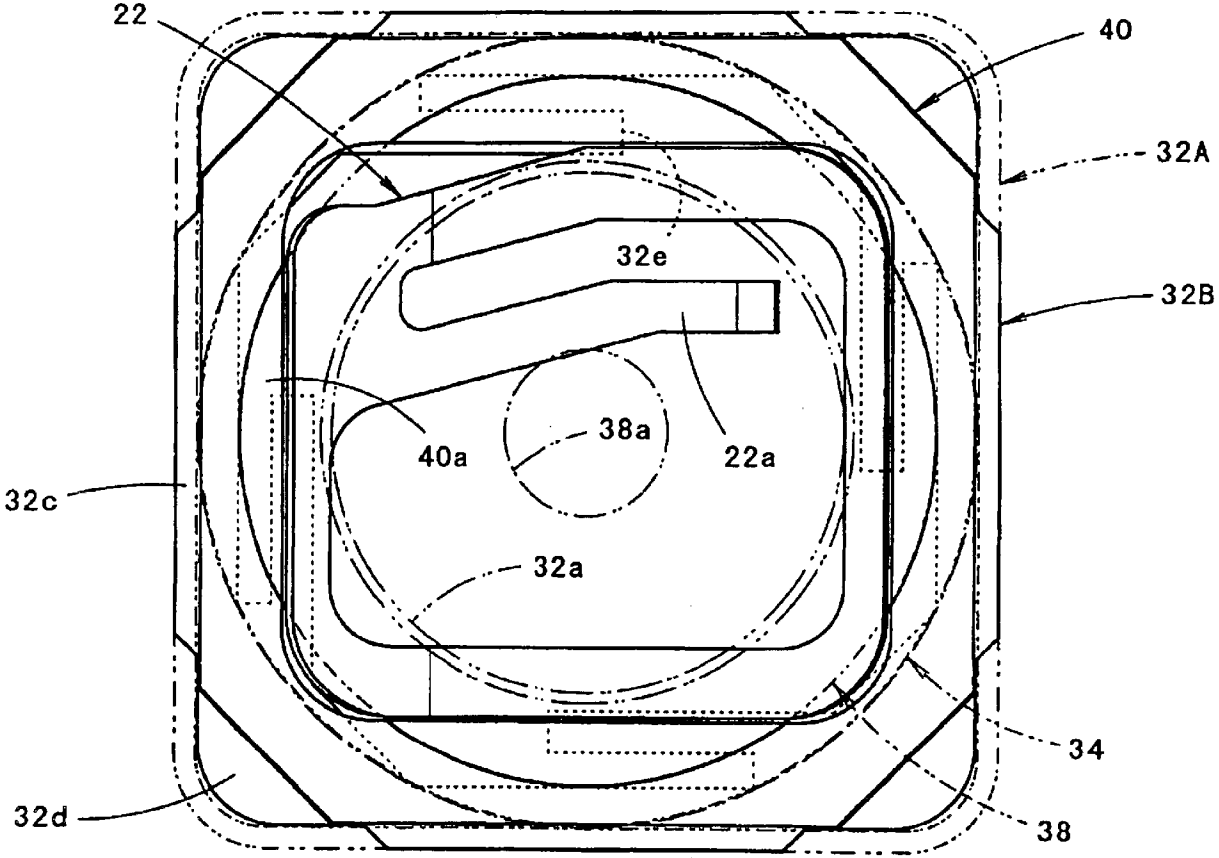
FIG. 4 is a front view showing an electrically insulating bush and a contact frame in the microphone assembly, together with the gate spring.

FIG. 4 is a front view showing the electrically insulating bush 40 and the contact frame 32B in the microphone assembly 14, together with the gate spring 22.

As also shown in FIG. 4, the electrically insulating bush 40 is a frame member made of a liquid crystal polymer substantially shaped like a rectangle. Bow-shaped recesses 40*a* are formed in a front portion of an inner circumferential surface of the electrically insulating bush 40 so as to be disposed at four places along the external shape of the back electrode plate 38. The back electrode plate 38 is fitted and fixed into the bow-shaped recesses 40*a* of the electrically insulating bush 40.

The gate spring 22 is substantially formed as a rectangular ring punched out of a stainless steel plate and partially bent so as to be V-shaped. An elastic piece 22*a* extending obliquely toward a space in the inside of the gate spring 22 is formed so as to be integrated with the gate spring 22.

The contact frame 32B is substantially formed as a rectangular ring punched out of a stainless steel plate and partially bent. Cover body-abutting portions 32*c* are formed in outer circumferential portions of four sides of the contact frame 32B respectively so that the cover body-abutting portions 32*c* abut on the open rear end edge 32*b* of the cover body 32A and are welded to the cover body 32A. Positioning pieces 32*d* are formed in four corners of the contact frame 32B respectively so that the positioning pieces 32*d* touch internally the cover body 32A and are engaged with the cover body 32A to thereby attain positioning of the cover body-abutting portions 32*c* relative to the open rear end edge 32*b* of the cover body 32A. Elastic pieces 32*e* extending obliquely backward are further formed in inner circumferential portions of the four sides of the contact frame 32B respectively by means of cutting and raising.

Figure 5:
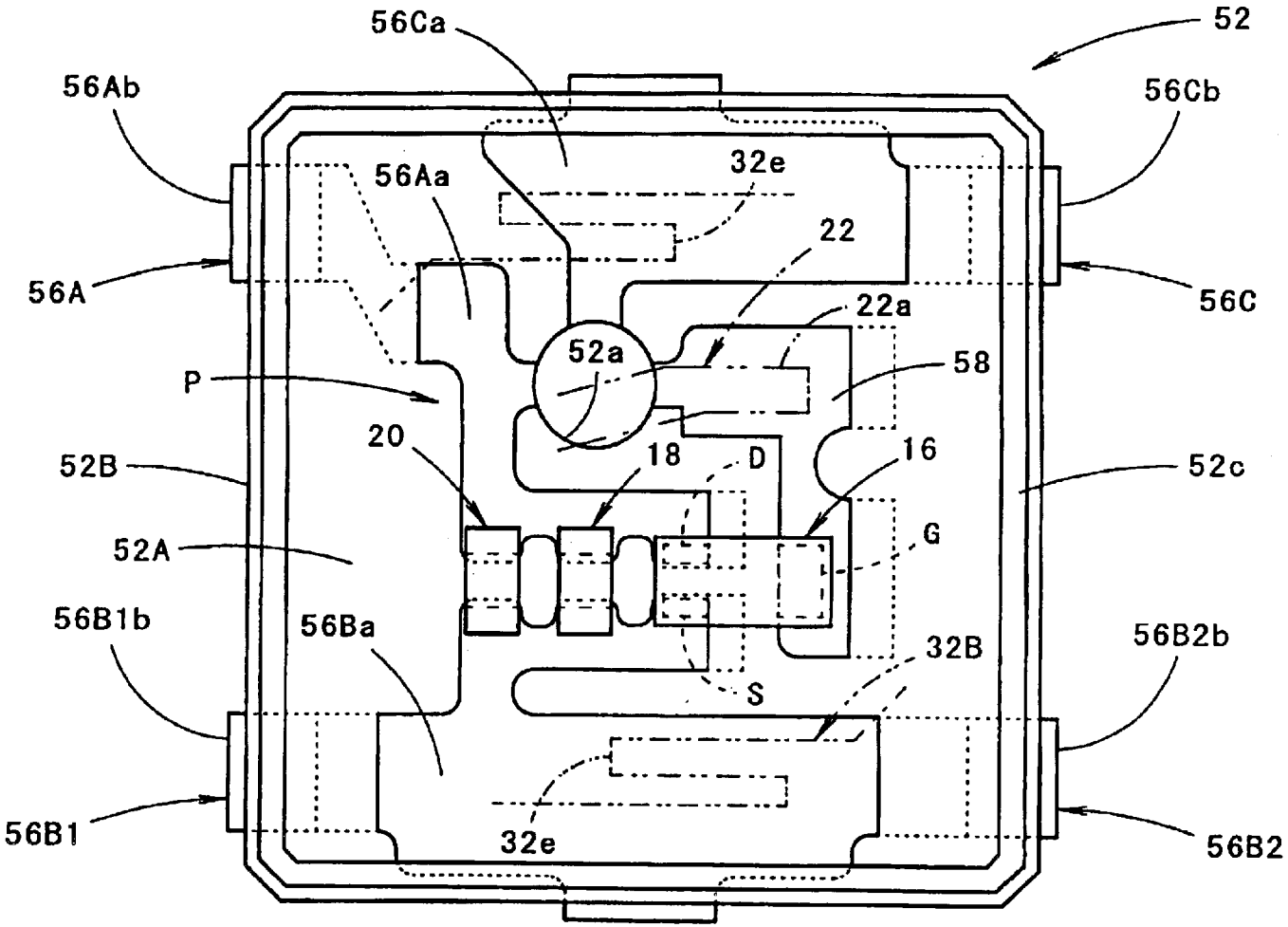
FIG. 5 is a front view showing a base housing in a housing of the electret capacitor microphone, together with a field-effect transistor and capacitors.

FIG. 5 is a front view showing the base housing 52 in the housing 12, together with the field-effect transistor 16 and the capacitors 18 and 20.

As also shown in FIG. 5, the base housing 52 has a rear wall 52A substantially shaped like a square, and an outer circumferential wall 52B extending forward from an outer circumferential edge portion of the rear wall 52A. The base housing 52 is formed by insert molding so as to be integrated with four terminal members 56A, 56B1, 56B2 and 56C. The four terminal members 56A, 56B1, 56B2 and 56C are formed as inserts by punching and bending a band plate-shaped electrically conductive member.

An end portion of each of the terminal members 56A, 56B1, 56B2 and 56C is exposed as one of three land portions 56Aa, 56Ba and 56Ca on an inner surface of the rear wall 52A. The three land portions 56Aa, 56Ba and 56Ca form part of an electrically conducting pattern P. On the other hand, the other end portion of each of the terminal members 56A, 56B1, 56B2 and 56C is exposed as one of four external connection terminal portions 56Ab, 56B1*b*, 56B2*b* and 56Cb on an outer surface of the rear wall 52A. Each of the external connection terminal portions 56Ab, 56B1*b*, 56B2*b* and 56Cb is L-shaped in a neighbor of a corresponding corner portion of the rear wall 52A so as to extend from the outer surface of the rear wall 52A to the outer surface of the outer circumferential wall 52B. On this occasion, the external connection terminal portions 56Ab, 56B1*b*, 56B2*b* and 56Cb are formed with respect to the rear wall 52A by insert molding so as to be located on the same plane with the outer surface of the rear wall 52A but the external connection terminal portions 56Ab, 56B1*b*, 56B2*b* and 56Cb are formed with respect to the outer circumferential wall 52B by cutting and bending-after insert molding so as to protrude by plate thickness from the outer surface of the outer circumferential wall 52B.

One 56A of the four terminal members 56A, 56B1, 56B2 and 56C is an output terminal which will be connected to a power supply through load resistance when the electret capacitor microphone is mounted on a surface of an external board. The terminal members 56B1 and 56B2 are ground terminals. The other terminal member 56C is a dummy terminal.

A through-hole 52*a* for separating the electrically conducting pattern P is formed in the rear wall 52A of the base housing 52. Part of the electrically conducting pattern P is separated by means of pin insertion, laser beam irradiation or the like to thereby form the through-hole 52*a*. As a result, a new land portion 58 electrically insulated from the land portions 56Aa and 56Ca is formed on the inner surface of the rear wall 52A of the base housing 52.

The field-effect transistor 16 and the capacitors 18 and 20 are mounted in the base housing 52 so as to be located in predetermined positions of the electrically conducting pattern P.

The field-effect transistor 16 is a device for conversing change of capacitance of the electret capacitor portion C into change of electrical impedance. The field-effect transistor 16 is mounted so that its drain electrode D is connected to the land portion 56Aa of the terminal member 56A, its source electrode S is connected to the land portion 56Ba of the terminal member 56B, and its gate electrode G is connected to the land portion 58. The capacitors 18 and 20 are two kinds of capacitors which are different in capacitance and which are provided for removing noise. The capacitors 18 and 20 are mounted in parallel with each other between the land portion 56Aa of the terminal member 56A and the land portion 56Ba of the terminal member 56B.

As represented by the chain double-dashed line in FIG. 5, a forward end portion of the elastic piece 22*a* of the gate spring 22 abuts on the land portion 58. In an unloaded condition, the size of the gate spring 22 in the front-rear direction is set to be larger by a certain degree than the distance between the rear surface of the back electrode plate 38 and the inner surface of the rear wall 52A of the base housing 52. As a result, at the stage in which assembling of the electret capacitor microphone 10 is completed, the elastic piece 22*a* is distorted to elastically press the back electrode plate 38 forward. As a result, the gate electrode G of the field-effect transistor 16 is surely electrically connected to the back electrode plate body 38A through the land portion 58 and the gate spring 22.

On this occasion, a gap of about 0.05 mm to about 0.1 mm is formed between the electrically insulating bush 40 and the contact fame 32B. This is based on the fact that the electrically insulating bush 40 is displaced in the direction of departing from the contact frame 32B simultaneously when the gate spring 22 presses the back electrode plate body 38A forward because the back electrode plate 38 and the electrically insulating bush 40 are fitted to each other.

As represented by the chain double-dashed line in FIG. 5, forward end portions of two elastic pieces 32*e* among the four elastic pieces 32*e* of the contact frame 32B abut on the land portions 56Ba and 56Ca. The size of each of the elastic pieces 32*e* in the front-rear direction is set to be larger by a certain degree than the distance between the rear surface of the contact frame 32B and the inner surface of the rear wall 52A of the base housing 52. As a result, at the stage in which assembling of the electret capacitor microphone 10 is completed, the elastic pieces 32*e* are distorted. As a result, the source electrode S of the field-effect transistor 16 is electrically connected to the diaphragm 34A through the land portion 56Ba of the terminal members 56B1 and 56B2, the contact frame 32B, the cover body 32A and the diaphragm support ring 34B. At the same time, the source electrode S is electrically connected to the land portion 56Ca of the terminal portion 56C so that the terminal portion 56C can be also used as a ground terminal.

A recess 52*b* having a predetermined shape is formed in the outer surface of the rear wall 52A of the base housing 52. A metal shield plate 60 having a thickness smaller than the depth of the recess 52*b* is provided in the recess 52*b*. Incidentally, the land portions 56Ba and 56Ca are exposed on the outer surface of the recess 52*b* so that the shield plate 60 can touch the land portions 56Ba and 56Ca.

The top housing 54 has a front wall 54A having the same shape as that of the rear wall of the base housing 52, and an outer circumferential wall 54B extending backward from an outer circumferential edge portion of the front wall 54A. A plurality of acoustic holes 54*a* are formed in the front wall 54A of the top housing 54.

The base housing 52 and the top housing 54 are ultrasonic-welded to each other as follows.

That is, as shown in FIG. 5, the base housing 52 before ultrasonic welding is provided so that the front end surface 52*c* of the outer circumferential wall 52B is substantially shaped like a pyramidal surface over its full circumference. On the other hand, the top housing 54 before ultrasonic welding is provided so that the rear end surface 54*b* of the outer circumferential wall 54B is shaped like a flat surface over its full circumference. In the condition that the front end surface 52*c* of the outer circumferential wall 52B of the base housing 52 and the rear end surface 54*b* of the outer circumferential wall 54B of the top housing 54 are brought into surface contact with each other over the full circumference, ultrasonic vibration is applied to the contact portion so that a neighbor of the front end surface of the outer circumferential wall 52B of the base housing 52 is mainly deformed plastically. Consequently, as shown in FIG. 1, the front end surface 52*c* of the outer circumferential wall 52B of the base housing 52 and the rear end surface 54*b* of the outer circumferential wall 54B of the top housing 54 are welded and fixed to each other over the full circumference.

As described above in detail, the electret capacitor microphone 10 according to this embodiment has a gate spring 22 having a pressing function for elastically pressing the back electrode plate 38 toward the diaphragm 34A to thereby form a predetermined gap between the electrically insulating bush 40 and the inner surface of the rear wall of the metal cover 32 (i.e., the front surface of the contact frame 32B). Accordingly, collapse of the spacer 36 abutting portion of the electret layer 38B can be prevented even in the case where a reflow process is applied to the electret capacitor microphone 10 in order to mount the electret capacitor microphone 10 on a surface of an external board.

That is, respective constituent members of the electret capacitor microphone 10 are expanded by heat generated in the reflow process. A predetermined gap is however formed between the electrically insulating bush 40 and the inner surface of the rear wall of the metal cover 32. Accordingly, even though the thermal expansion coefficient of the electret capacitor portion C or the electrically insulating bush 40 is larger than that of the metal cover 32, pressure interference caused by thermal expansion can be prevented from acting on constituent members of the electret capacitor portion C and the electrically insulating bush 40. Accordingly, the distance between the diaphragm 34A and the back electrode plate 38 can be prevented from becoming smaller than the set value because of collapse of the spacer-abutting portion of the electret layer 38B caused by thermal expansion. Consequently, sensitivity characteristic of the electret capacitor microphone 10 can be prevented from changing.

Moreover, because the gate spring 22 always elastically presses the back electrode plate 38 toward the diaphragm 34A, the distance between the back electrode plate 38 and the diaphragm 34A can be kept constant by appropriate pressure at all the time before and after the reflow process.

For this reason, change of sensitivity characteristic can be prevented even in the case where the reflow process is applied to the electret capacitor microphone 10.

Particularly in this embodiment, the electrically insulating bush 40 is made of a liquid crystal polymer having a thermal expansion coefficient not larger than that of the metal cover 32 made of stainless steel, and the back electrode plate 38 and the diaphragm sub-assembly 34 as constituent members of the electret capacitor portion C except the diaphragm 34A and the electret layer 38B are made of stainless steel. Accordingly, the gap to be formed between the electrically insulating bush 40 and the inner surface of the rear wall of the metal cover 32 can be minimized by the pressing function of the gate spring 22. For this reason, reduction in thickness and size of the electret capacitor microphone 10 and improvement in degree of freedom for designing the electret capacitor microphone 10 can be attained. Incidentally, also in the case where the liquid crystal polymer used as the material of the electrically insulating bush 40 is replaced by a ceramic substance or the like, the thermal expansion coefficient of the electrically insulating bush 40 can be set to be not larger than that of the metal cover 32.

Moreover, in this embodiment, the metal cover 32 is stored in the housing 12 made of a synthetic resin. The base housing 52 of the housing 12 is formed by insert molding so as to be integrated with a plurality of terminal members 56A, 56B1, 56B2 and 56C. One end portion of each of the terminal members 56A, 56B1, 56B2 and 56C is exposed as part of the electrically conducting pattern P on the inner surface of the rear wall 52A of the base housing 52. The other end portion of each of the terminal members 56A, 56B1, 56B2 and 56C is exposed as one of external connection terminal portions 56Ab, 56B1*b*, 56B2*b* and 56Cb on the outer surface of the rear wall 52A of the base housing 52. Further, the field-effect transistor 16 is mounted on the inner surface of the rear wall 52A so as to be located in a predetermined position of the electrically conducting pattern P. Accordingly, the electret capacitor microphone 10 can be mounted on a surface of an external board directly without interposition of any holder or the like. On this occasion, because the gate spring 22 is disposed so as to abut on a predetermined position of the electrically conducting pattern P, the gate spring 22 can be used as an electrically conducting member. For this reason, the electret capacitor microphone 10 can be constituted by a small number of parts and reduction in thickness and size of the electret capacitor microphone 10 can be attained, so that the electret capacitor microphone 10 can be suited to be mounted on a surface of an external board.

In addition, in this embodiment, the contact frame 32B for forming the rear wall of the metal cover 32 is provided so that a plurality of elastic pieces 32*e* protruding backward are formed so as to be integrated with the contact frame 32B. The elastic pieces 32*e* are disposed so as to abut on predetermined positions of the electrically conducting pattern P. Accordingly, when the base housing 52 and the top housing 54 are fixed to each other by ultrasonic welding as described above in this embodiment, the metal cover 32 and the electrically conducting pattern P can be surely electrically connected to each other though sufficient dimensional accuracy in the front-rear direction of the housing 12 cannot be obtained.

Although the embodiment has been described on the case where the cover body 32A and the contact frame 32B are welded to each other to thereby form the metal cover 32, the invention may be also applied to the case where the cover body 32A and the contact frame 32B are engaged with each other or simply brought into contact with each other instead. Further, the invention may be configured so that the open rear end edge 32*b* of the cover body 32A is bent to the inner circumferential side.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An electret capacitor microphone comprising:

an electret capacitor portion including a diaphragm, and a back electrode plate disposed opposite to the diaphragm through a spacer;

an electrically insulating bush for electrically insulating/supporting an outer circumferential edge portion of the back electrode plate;

a metal cover in which the electret capacitor portion and the electrically insulating bush are stored;

an impedance conversion device for converting change of capacitance of the electret capacitor portion into change of electrical impedance; and an elastic member having a pressing function for elastically pressing the back electrode plate toward the diaphragm to form a predetermined gap between the electrically insulating bush and an inner surface of a rear wall of the metal cover.

2. The electret capacitor microphone according to claim 1, wherein the electrically insulating bush is made of a material having a thermal expansion coefficient not larger than that of the metal cover.

3. The electret capacitor microphone according to claim 2, wherein the metal cover is stored in a housing made of a synthetic resin;

the housing has a rear wall formed by insert molding so as to be integrated with a plurality of terminal members;

each of the terminal members has an end portion exposed as part of an electrically conducting pattern on an inner surface of the rear wall of the housing, and the other end portion exposed as an external connection terminal portion on an outer surface of the rear wall of the housing;

the impedance conversion device is mounted in the inner surface of the rear wall of the housing so as to be disposed in a predetermined position of the electrically conducting pattern; and the elastic member is disposed so as to abut on the predetermined position of the electrically conducting pattern.

4. The electret capacitor microphone according to claim 3, wherein a plurality of elastic pieces protruding backward are formed in the rear wall of the metal cover so as to be integrated with the rear wall; and each of the elastic pieces is disposed so as to abut on the predetermined position of the electrically conducting pattern.

5. The electret capacitor microphone according to claim 1, wherein the metal cover is stored in a housing made of a synthetic resin;

the housing has a rear wall formed by insert molding so as to be integrated with a plurality of terminal members;

each of the terminal members has an end portion exposed as part of an electrically conducting pattern on an inner surface of the rear wall of the housing, and the other end portion exposed as an external connection terminal portion on an outer surface of the rear wall of the housing;

the impedance conversion device is mounted in the inner surface of the rear wall of the housing so as to be disposed in a predetermined position of the electrically conducting pattern; and the elastic member is disposed so as to abut on the predetermined position of the electrically conducting pattern.

6. The electret capacitor microphone according to claim 5, wherein a plurality of elastic pieces protruding backward are formed in the rear wall of the metal cover so as to be integrated with the rear wall; and each of the elastic pieces is disposed so as to abut on the predetermined position of the electrically conducting pattern.

* * * * *